United States Patent [19]

Makabe et al.

[11] 4,389,954

[45] Jun. 28, 1983

[54] ELECTRONIC SEWING MACHINE

[75] Inventors: Hachiro Makabe, Kanagawa; Haruhiko Tanaka, Mitaka, both of Japan

[73] Assignee: Janome Sewing Machine Co. Ltd., Tokyo, Japan

[21] Appl. No.: 315,209

[22] Filed: Oct. 26, 1981

[30] Foreign Application Priority Data

Oct. 31, 1980 [JP] Japan ..... 55/152265

[51] Int. Cl.[3] ..... D05B 3/02

[52] U.S. Cl. ..... 112/158 E

[58] Field of Search ..... 112/158 E, 121.11, 121.12

[56] References Cited

U.S. PATENT DOCUMENTS 4,200,048 4/1980 Makabe et al. ..... 112/158 E 4,266,493 5/1981 Hanyu et al. ..... 112/158 E

*Primary Examiner*—Peter P. Nerbun

*Attorney, Agent, or Firm*—Michael J. Striker

[57] ABSTRACT

A plurality of different stitch patterns are stored in a first static memory. A second static memory memorizes a combination of these different patterns in a predetermined sequence. A third static memory stores basic needle position signals each specific to the patterns stored in the first memory. Calculating means utilize signals derived from the second memory and the third memory to determine values for adjusting the swinging amplitude of the sewing needle with a common variation rate and for setting a common basic needle position.

1 Claim, 5 Drawing Figures

ELECTRONIC SEWING MACHINE

BACKGROUND OF THE INVENTION

The invention relates to a sewing machine electronically storing the stitch control data which are sequentially read out to produce various patterns of stitches. More particularly the objective of the invention is to control the basic or reference needle position of a member of patterns which are produced sequentially in combination by such a type of sewing machine.

In a zigzag sewing machine which may produce various patterns, it is generally required to produce the stitch patterns with a predetermined basic (or reference) needle position which may be located at the right end, left end or the middle of the maximum swinging range of the needle most properly for the patterns. In case the sewing machine operator wishes to produce a number of patterns sequentially in combination especially with adjustment of the needle swinging amplitude, it is undesirable that the needle swinging amplitude be adjusted on both sides of the basic needle positions which may be different in dependence upon the different patterns. Namely, it is undesirable to shift the basic needle positions each in dependence upon the different patterns. It is therefore a primary object of the invention to memorize a combination of different patterns with designation of a basic (or reference) needle position common to these patterns.

According to the conventional sewing machine producing stitch patterns including straight stitches, the straight stitches are produced with a basic needle position generally set at the center (or middle) M of the maximum swinging range of the needle. It is actually desirable for many stitch patterns including zigzag stitches to set the basic needle position at the center M of the maximum needle swinging range. This requirement, however, different with respect to a pattern such as a pattern of a tulip as shown in FIGS. 1(A) and 1(B). As to the patterns such as the tulip, it is preferable to set the basic needle position at the left end L of the maximum needle swinging range, because such a pattern is easily positioned with the basic needle position L with respect to the fabric to be sewn, and because the pattern may be varied in size from minimum to maximum with reference to the basic needle position L. As to the pattern of blind stitches, it is preferable to set the basic needle position at the left end L of the maximum needle swinging range, because such stitches are produced with reference to the edge of the fabric to be sewn. No problem arises if the different stitch patterns of different basic needle positions are produced separately and individually. A problem arises if these patterns are produced sequentially in combination. Namely, the difference of basic needle positions prevents the combination of patterns from being produced in alignment with each other. Actually if the combined patterns of different basic needle positions are produced in the maximum size in the maximun needle swinging range, these patterns are produced in alignment with each other and no problem arises as shown in FIG. 1(A). On the other hand, if the size of these combined patterns are adjusted (or reduced), these patterns are so reduced with reference to the difference basic needle positions each specific to the patterns, and as the result, the sequential patterns are produced to and fro out of alignment.

SUMMARY OF THE INVENTION

An object of the present invention is to solve such a problem of the prior art. In keeping with this object and other which will become apparent hereafter, the invention substantially comprises; a first memory storing stitch control data for different stitch patterns to be selectively produced, pattern selecting means including a number of pattern selecting switches which are selectively operated to produce a pattern signal designating the corresponding are of the patterns stored in the first memory, pattern memory control means operated to determine a combination of different patterns, a second memory operated in response to the operation of the pattern selecting means and of the pattern memory control means to memorize the combination of different patterns in a predetermined sequence, needle swing adjusting means operated to adjust the swinging amplitude of the needle with a common variation rate with respect to each of the stitch control data read out from the first memory in response to the designation of the patttern signals memorized in the second memory, a third memory storing basic needle position designating signals each specific to the patterns stored in the first memory, basic needle position control means operated in response to the operation of the pattern memory control means to memorize a specific one of the basic needle position designating signals to control the stitches of the designated combined patterns with a common basic needle position, calculating means operated in response to the output signal of the basic needle control means, the stitch control signal of the first memory and the output signal of the needle swing adjusting means to adjust the swinging amplitude of the needle with a common variation rate with respect to each of the stitches of the combined patterns, and to set a common basic needle position for the patterns, and stitch forming means operated in response to the output of the calculating means to produce the stitches of the combined patterns. According to another feature of the invention, separate and individual patterns are produced with the basic needle positions each specific to the patterns.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1B:
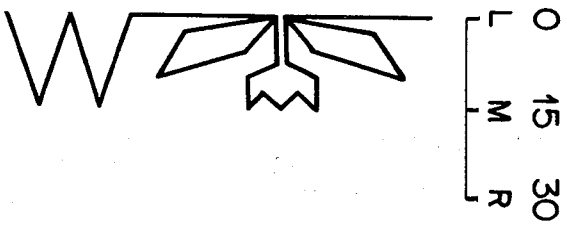
FIGS. 1(A) and 1(B) show by way of an example the stitch patterns to be produced by the invention.
Figure 1A:
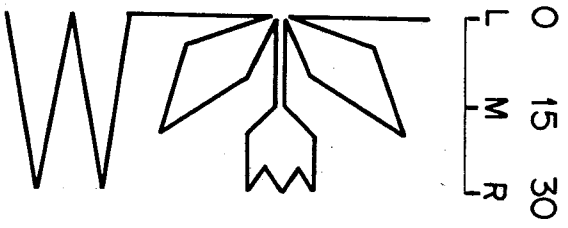

FIG. 1(A) shows a combination of patterns, a tulip of stitches and a zigzag of stitches which are stored in a memory to be alternately and repeatedly produced with a full swinging amplitude of needle and with a basic or reference needle position L within the maximum range between the right end needle position R and the left end needle position L corresponding to signals 30 and 0 respectively. The needle position M is the center of the maximum swinging range of the needle and corresponds to a signal 15. FIG. 1(B) shows the same patterns as those of FIG. 1(A), but these patterns are reduced into a half of the patterns of FIG. 1(A) in the zigzag amplitude of needle.

Figure 2:
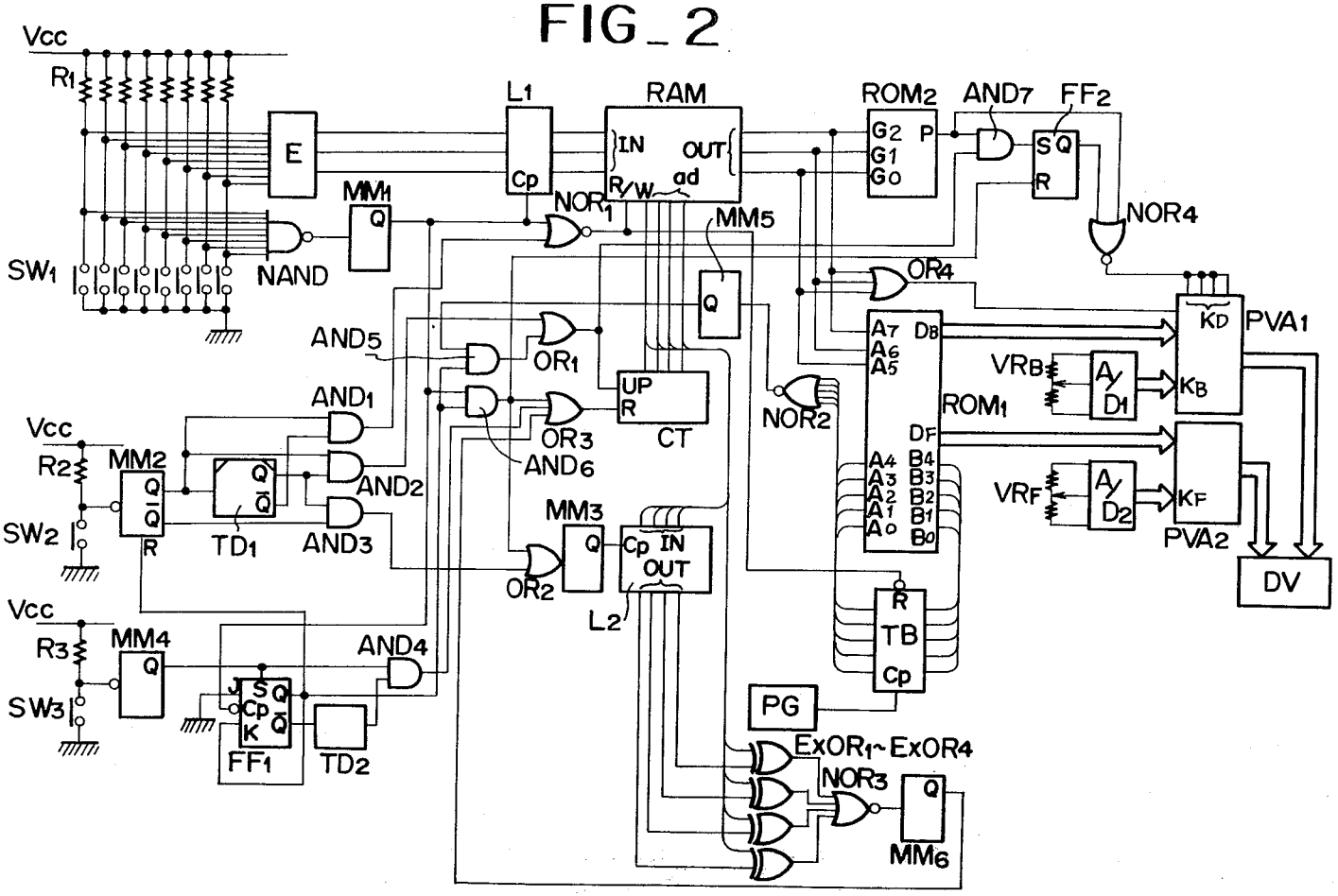
FIG. 2 shows a control circuit of the invention.

FIG. 2 shows a control circuit designed to produce the patterns as shown in FIG. 1(A) and FIG. 1(B), in which $SW_1$ is a pattern selecting device including a number of switches selectively operated to produce a pattern signal of a selected pattern to be stitched. An encoder E receives the pattern signal and produces a 3-bit code signal to a latch circuit $L_1$. Vcc is a positive control power source, and $R_1$ denotes pull-up resistors. $MM_1$ is a monostable multivibrator circuit which receives the pattern signal from the pattern selecting device $SW_1$ through a NAND circuit NAND. The monostable multivibrator circuit has an output terminal Q to give the pattern signal to the trigger terminal of the latch circuit $L_1$, so that the latch circuit may latch the code signal from the encoder E. RAM is an electronic memory for tempoarily memorize the data of the input terminal IN in the columns designated by a 4-bit address (ad) in accordance to the writing order of a mode designation terminal R/W, and for producing a signal at the output terminal OUT in accordance to a readout order.

$ROM_1$ is an electronic memory fixedly storing the stitch control data of patterns to be stitched, and has address terminals $A_0$–$A_1$, of which the terminals $A_5$–$A_7$ receive a pattern code signal directly or indirectly from the output terminal OUT of the memory RAM. $SW_2$ is a memory switch which is operated to produce a falling signal to actuate a monostable multivibrator circuit $MM_2$. Then the monostable multivibrator circuit $MM_2$ gives the output at the true side output terminal Q to a delay circuit $TD_1$ and to one input of AND circuit $AND_1$ which has another input receiving the complement side output Q. The AND circuit $AND_1$ has an output connected to one input of NOR circuit $NOR_1$. $R_2$ is a pull-up resistor. The NOR circuit $NOR_1$ has another input receiving the output Q of the monostable multivibrator circuit $MM_1$, and has an output connected to the mode designation terminal R/W of the memory RAM, so as to memorize or rewrite the signal of latch circuit $L_1$ into the memory RAM each time the switch $SW_1$ or $SW_2$ is operated. When the switches $SW_1$, $SW_2$ are not operated, the terminal R/W is high level for ordering the memory RAM to read out the data. When these switches are operated, the terminal R/W temporarily becomes low level for ordering the memory to rewrite the data after a counter CT is operated by operation of the switch $SW_2$ to advance the addresses of the memory ROM. If the pattern selecting switches $SW_1$ are selectively operated more than two times without operation of the memory switch $SW_2$ the last switch is made effective, and accordingly the pattern data is memorized.

The counter CT is reset when the control power source is applied, and has a count-up terminal UP receiving, through OR circuit $OR_1$, the output of AND circuit $AND_2$ which receives the true side outputs Q of the monostable multivibrator $MM_2$ and of the delay circuit $TD_1$. The counter is operated to count up when the memory switch $SW_2$ is operated. $L_2$ is a latch circuit and has an input terminal IN receiving the count-up signal of the counter CT, and has a trigger terminal CP receiving the output signal of the memory switch $SW_2$ through AND circuit $AND_3$, OR circuit $OR_2$ and monostable multivibrator circuit $MM_3$, said AND circuit $AND_3$ receiving the complement side output Q of monostable multivibrator circuit $MM_2$ and the true side output Q of delay circuit $TD_1$. Thus the latch circuit $L_2$ latches the count-up signal of the counter CT when the switch $SW_2$ is operated.

TB is a timing buffer having a reset terminal connected to the output of NOR circuit $NOR_1$, and produces the output O each time the switches $SW_1$, $SW_2$ are operated, and accordingly makes O the address inputs $A_0$–$A_4$ of the memory $ROM_1$. The timing buffer TB has a trigger terminal CP receiving a pulse signal of a pulse generator PG operated in synchronism with rotation of drive shaft of sewing machine (not shown), thereby to latch the address signals $B_0$–$B_4$ and advance the address of the memory $ROM_1$ per stitch. The relation between the timing buffer TB and the memory $ROM_1$ is described in detail in U.S. Pat. No. 4,086,862 and the copending German patent application Ser. No. 26 26 322.9, both of the same applicant.

The memory $ROM_1$ stores the needle control data DB and the feed control data EF which are to be transmitted to calculating device $PVA_1$, $PVA_2$ respectively. The calculating devices $PVA_1$, $PVA_2$ receive the adjusting signals of needle swing amplitude adjusting device VRB and of feed adjusting device VRF respectively as the reduction rate data KB, KF through analog-digital converters $A/D_1$, $A/D_2$, and make calculations including the multiplications of the data KB, KF and the control data DB, DF respectively to produce the outputs to stitch forming device DV. When the needle control data DB is 0, it designates the needle coordinate R, and when the data is 30, it designates the needle coordinate L. Thus the maximum needle swinging range between 0 and 30 are evenly divided into 30 for so many needle coordinates. When the feed control data DF is 0, it designates the maximum fabric feeding movement in the backward direction, and when the data is 30, it designates the maximum fabric feeding movement in the forward direction.

$SW_3$ is a controller switch which is closed as a controller (not shown) is operated and produces a falling signal to operate a monostable multivibrator circuit $MM_4$. $R_3$ is a pull-up resistor. The monostable multivibrator circuit $MM_4$ has a true side output Q connected to a set terminal S of JK type flip-flop circuit $FF_1$ to set the latter when the switch $SW_3$ is operated. The same circuit $MM_4$ has a terminal J grounded and of low level, and has a terminal K connected to a true side output terminal Q of the flip-flop circuit $FF_1$. The flip-flop circuit $FF_1$ has a trigger terminal CP receiving the output Q of the monostable multivibrator $MM_1$ and is reset by the falling signal applied thereto. AND circuit $AND_4$ receives the output Q of the monostable multivibrator circuit $MM_4$ and the output of delay circuit $TD_2$ which is operated by the complement side output Q of the flip-flop circuit $FF_1$. The AND circuit $AND_4$ has an output connected to the reset terminal R of the counter CT through OR circuit $OR_3$, so at the reset the counter when the controller switch $SW_3$ is closed after the pattern selecting switch $SW_1$ is operated.

The flip-flop circuit $FF_1$ has the true side output terminal Q connected to a reset terminal R of the monostable multivibrator circuit $MM_2$ and to the inputs of AND circuits $AND_5$, $AND_6$. The address signals $A_0$–$A_4$ of the memory $ROM_1$ are 0 for the first stitch and operate a monostable multivibrator $MM_5$ through the NOR circuit $NOR_2$. The monostable multivibrator $MM_5$ has an output terminal Q connected to another input of the AND circuit $AND_5$, which has the output to the count-up terminal UP of the counter CT through the OR circuit $OR_1$, to start the count-up of the counter CT each time a new pattern is stitched. The AND circuit AND 6 has another input connected to the output Q of the monostable multivibrator $MM_1$, and is so connected as to reset the counter CT through the OR circuit $OR_3$ when the pattern selecting switch $SW_1$ is operated after operation of the controller switch $SW_3$, and is so connected to latch the value O of the counter CT in the latch circuit $L_2$, and is so connected to reset a flip-flop circuit $FF_2$.

Exclusive OR circuits $EXOR_1$-$EXOR_4$ compare the signal of the counter CT and the signal OUT of the latch circuit $L_2$ as to the bits thereof and, if these bits are all in accord, operate a monostable multivibrator circuit $MM_6$ through a NOR circuit $NOR_3$. The output Q of the monostable multivibrator circuit $MM_6$ resets the counter CT for stitching the first one of the combined patterns.

$ROM_2$ is an electronic memory fixedly storing the data for controlling the basic (or reference) position of the needle of sewing machine. The memory $ROM_2$ has the inputs $G_0$, $G_1$, $G_2$ receiving a code signal from the output terminal OUT of the memory RAM, and has an output terminal P for producing an output signal in response to the code signal to control the basic position of needle. The basic needle position control signal is low level directing the basic needle position to the center M for the ordinary stitch patterns including the straight stitches. On the other hand, the basic needle position control signal is high level for the stitch patterns including the tulip patterns as shown in FIG. 1 which require a basic needle position at the left end L of the maximum needle swing range.

The flip-flop circuit $FF_2$ is, as aforementioned, reset each time the pattern selecting switch $SW_1$ is operated after operation of the controller switch $SW_3$, and has a set terminal S receiving the output signal of AND circuit $AND_7$ which receives the output signal P of the memory $ROM_2$ and the output of OR circuit $OR_1$. The pattern designation due to operation of the pattern selecting switch $SW_1$ maintains the output P of the memory $ROM_2$ in high level, and the flip-flop circuit $FF_2$ is set when the memory switch $SW_2$ is operated. Namely if the patterns memorized in the memory RAM include a pattern or patterns of the basic needle position L, the flip-flop circuit $FF_2$ is set and the output Q becomes high level. If the memorized patterns include no pattern of the basic needle position L, the output Q remains low level.

NOR circuit $NOR_4$ receives the output Q of the flip-flop circuit $FF_2$ and the output P of the memory $ROM_2$, and produces a 4-bit output as a basic needle position control code KD given to the calculation device of needle position $PVA_1$. The NOR circuit $NOR_4$ directly receives the output P of the memory $ROM_2$ for the ordinary patterns not accompanied by the pattern memorizing operation. OR circuit $OR_4$ receives the output OUT of all bits of the memory RAM, and has the output connected to the needle position calculating device $PVA_1$. In this embodiment, if the pattern selecting switch $SW_1$ is operated to select the straight stitches, the designation code makes the output OUT of the memory RAM 0 0 0 (the corresponding relation is not shown), and gives 0 to the calculating device $PVA_1$, and gives a signal including 1 for the patterns other than the straight stitches.

The needle position calculating device $PVA_1$ receives the needle position control signal DB of the memory $ROM_1$, the needle position reduction rate signal KB, the basic needle position control code KD and the output signal of the OR circuit $OR_4$, and makes a calculation $(DB-KD)\times KB+KD$. When the output signal of the OR circuit $OR_4$ is 1, the calculating device $PVA_1$ gives the result of the calculation to the stitch forming device DV. When the output signal of the OR circuit $OR_4$ is 0, the calculating device $PVA_1$ gives the result of the calculation as the data KD to the stitch forming device DV. The fabric feed calculating device $PVA_2$ receives the feed control signal DF and the feed reduction rate signal KF, and makes a calculation $DF\times KF$, and gives the result of the calculation to the stitch forming device DV.

Figure 3:
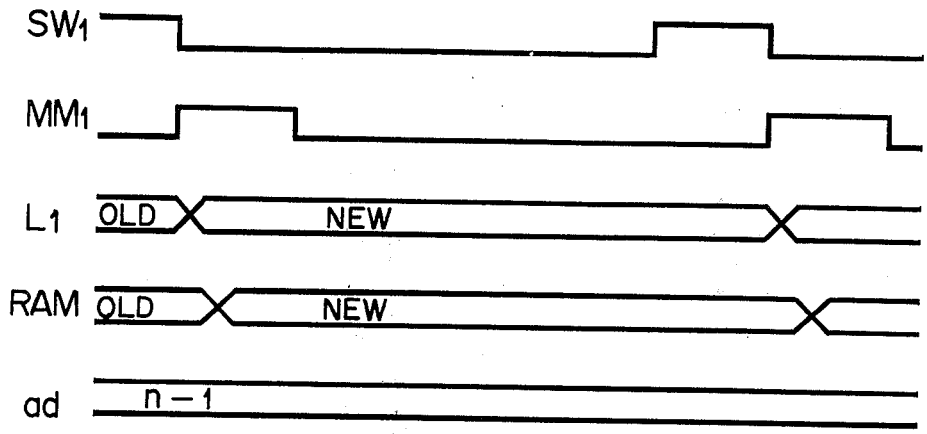
FIGS. 3 and 4 are the timing diagrams showing the operations of the control circuit in FIG. 2.
Figure 4:
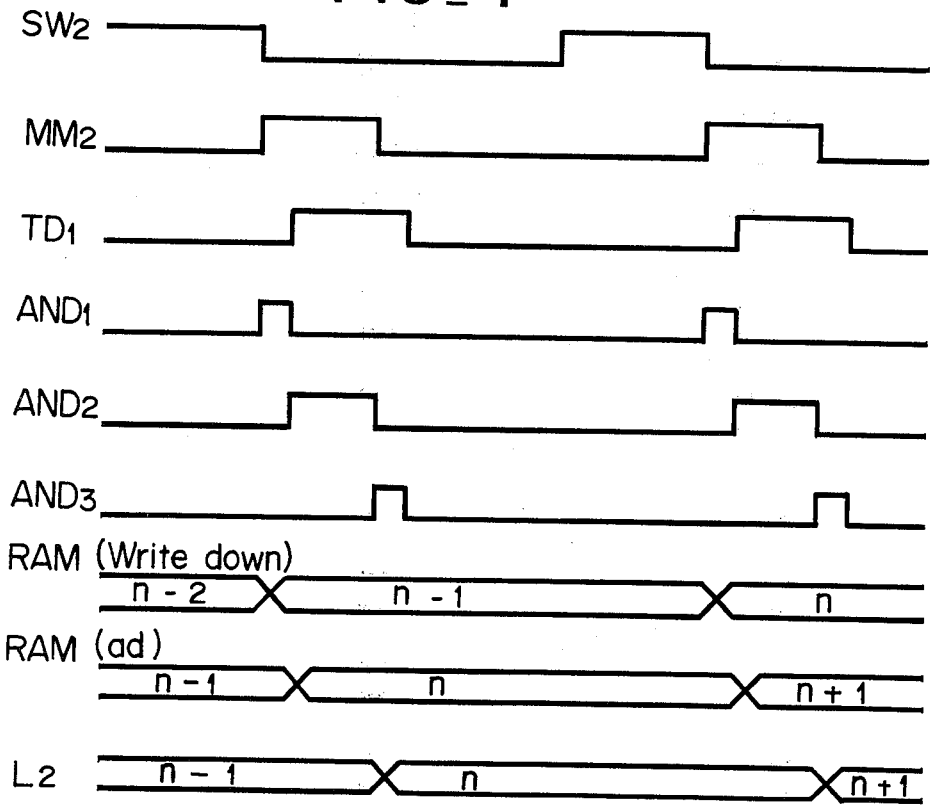

With the above-mentioned combination of elements, the operation of the control circuit will now be described in reference to the time charts in FIGS. 3 and 4. If one of the pattern selecting switches $SW_1$ is operated to select the tulip pattern as shown in FIG. 1, a falling signal is produced to operate the monostable multivibrator circuit $MM_1$. Then the latch circuit $L_1$ is operated to latch a new data NEW in place of an old data OLD, and the temporal memory RAM is operated to memorize a new data NEW in place of an old data OLD. At this time, it is to be assumed that the address (ad) of the memory is $n-1$. As the flip-flop circuit $FF_1$ is reset with operation of the pattern selecting switch $SW_1$, the AND circuit $AND_6$ nullifies the signal of the switch $SW_1$, and therefore the counter CT is not reset and has no count-up signal.

Subsequently, if the memory switch $SW_2$ is operated, a falling signal is produced to operate the monostable multi-vibrator circuit $MM_2$ for producing a pulse signal, and then the delay circuit $TD_1$ is operated to produce a pulse of the same width as that of the monostable multivibrator circuit $MM_2$. With the combination of the two pulse signals, the AND circuits $AND_1$, $AND_2$, $AND_3$ produce a pulse one after another as shown in FIG. 4. The mode designation terminal R/W of the memory RAM is made low level with the rising signal of the AND circuit $AND_1$, and the new data NEW is memorized again at the address (ad), which is $n-1$, of the memory RAM. With the subsequent rising signal of the AND circuit $AND_2$, the counter CT starts to count up, and the address (ad) becomes (n). With the subsequent rising signal of the AND circuit $AND_3$, the latch circuit $L_2$latches the output data (n) of the counter CT.

Then if another pattern selecting switch $SW_1$ is operated to select the zigzag pattern as shown in FIG. 1 in combination with the tulip pattern, the latch circuit $L_1$ latches the pattern designation signal. Subsequently if the memory switch $SW_2$ is operated, the memory RAM is ordered, through the AND circuit $AND_1$, NOR circuit $NOR_1$, to memorize the pattern designation signal at the address (n) thereof. In the same manner, the counter CT starts to count up, and the address (ad) becomes $n+1$. With such alternate operations of the switches $SW_1$, $SW_2$, the memory RAM is inscribed with the pattern data with advance of the addresses, and the latch circuit $L_2$ latches the output data of the counter CT as a total number of patterns to be stitched. In this embodiment, it is to be assumed that the tulip and zigzag patterns have been memorized in combination as shown in FIGS. 1(A) and 1(B).

With the aforementioned selection of the tulip pattern, the basic needle position control signal P of the memory $ROM_2$ is high level, and the flip-flop circuit $FF_2$ is set with the subsequent operation of the memory switch $SW_2$ and by way of the AND circuit $AND_2$, OR circuit $OR_1$, AND circuit $AND_7$. With the aforementioned subsequent selection of the zigzag pattern, one input of the AND circuit $AND_6$ is high level, but the flip-flop circuit $FF_2$ is not reset because the flip-flop circuit $FF_1$ is reset. Therefore, after the selection of the first pattern, the basic needle position control code KD of the calculating device $PVA_1$ remains 0 0 0 0, i.e., decimally 0.

Then if the machine controller (not shown) is operated to close the switch $SW_3$, the flip-flop circuit $FF_1$, is set. Then the counter CT is reset, and the address (ad) of the memory RAM becomes 0. This corresponds to the initial address of the stitch control data of the first tulip pattern stored in the memory $ROM_1$, and is mentioned hereinbefore as the address n−1. The calculating devices $PVA_1$, $PVA_2$ respectively receive the needle position control data DB and the feed control data DF read out from the memory $ROM_1$ at the initial address $A_7$–$A_5$ of the address signal $A_7$–$A_0$ (the rest are all 0) of the tulip pattern, and the corresponding reduction rate data KG, KF respectively of the needle swing adjusting device VRB and the feed adjusting device VRF. The calculating device $PVA_1$ further receives the basic needle position control code KD as 0 0 0 0 and the signal 1 of the OR circuit $OR_4$, and makes a calculation $(DB-0)\times KB+0$ and gives the result to the stitch forming device DB.

As the sewing machine is rotated, the pulse generator PG is operated in synchronism with rotation of the drive shaft of sewing machine and produces a timing pulse. The first pulse reads out the data DB, DF from the initial address of the memory $ROM_1$ for the first stitch, and correspondingly the address data $B_4$–$B_0$ are read out and latched at the timing buffer TB for the address input $A_4$–$A_0$ of the second stitch. Thus the stitches are progressively produced as the sewing machine rotates. As the address data DB, DF are O, which are read out together with the stitch control data DB, DF for the last stitch of the unit pattern, the counter CT counts up. Then the memory RAM designates the initial address of the next zigzag pattern of the memory $ROM_1$. The stitches are similarly produced, and the counter CT counts up. When the value of the counter comes to be in accord with the total number of patterns latched in the latch circuit $L_2$, the monostable multivibrator circuit $MM_6$ is operated to reset the counter. Therefore, the stitch is returned to the first one of the tulip pattern, and the combination of patterns is repeatedly produced. As the basic needle position control code KD and the output of OR circuit $OR_4$ are constant all through the production of stitch control data DB, DF in formation of the two stitch patterns, the calculations $(DB-0)+0=DB$ is obtained in case the needle swing reduction rate KB by the needle swing adjusting device VRB is 1, and as the result, the maximum (not reduced) combination of patterns is produced as shown in FIG. 1(A). If the reduction rate KB is 0.5, the calculation $(DB-0)\times 0.5=0.5$ DB is obtained, and as the result, the combination of patterns is produced as shown in FIG. 1(B) which is ½ of the needle swing amplitude with the basic needle position L. With respect to the feed control, the theory is the same with that of the needle position control and therefore the explanation is omitted here.

If the pattern of straight stitches is selected in place of the zigzag stitch pattern to be combined with the tulip pattern, the flip-flop circuit $FF_2$ is set due to the property of the tulip pattern, and the basic needle position control code KD is 0 0 0 0 and the tulip pattern is produced in the same manner as above-mentioned. Upon subsequent stitching of the straight stitches, the output OUT of the memory RAM is 0 0 0, and the output of the OR circuit $OR_4$ is 0. The output of the calculating device $PVA_1$ is 0 0 0 0 which is the data of the basic needle position control data, and the basic needle position is shifted to the position L irrespectively of the stitching process and the adjustment by the adjusting device VRB.

As to the formation of these three patterns individually, the memory switch $SW_2$ is not operated, and therefore the flip-flop circuit $FF_2$ is not reset. Since the NOR circuit $NOR_4$ directly receives the output P of the memory ROM, the basic needle position control signal KD is 0 0 0 0 for the tulip pattern, and 1 1 1 1 for the other patterns. Therefore, the tulip pattern is formed in the manner as aforementioned. As to the zigzag pattern, the output of the calculating device is $(DB-15)\times KG+15$, and the result is DB when the reduction rate KB is 1, and the maximum zigzag pattern is produced as shown in FIG. 1(A). If the reduction rate KB is 0, the result of calculation is 15, and the zigzag pattern is reduced on the center basic needle position M. As to the straight stitches, the basic needle position control signal KD is 1 1 1 1, and the output of the OR circuit $OR_4$ is 0. The output of the calculating device $PVA_1$ is therefore 1 1 1 1 which is the same value with the data KD. Thus, the straight stitches are formed on the center basic needle position M.

What is claimed as new and desired to be protected by Letters Patent is set forth in the appended claims:

1. An electronic sewing machine comprising: a first memory storing stitch control data for different stitch patterns to be selectively produced, pattern selecting means including a number of pattern selecting switches which are selectively operated to produce a pattern signal designating the corresponding one of the patterns stored in the first memory, pattern memory control means operated to determine a combination of different patterns, a second memory operated in response to the operation of the pattern selecting means and of the pattern memory control means to memorize the combination of different patterns in a predetermined sequence, needle swing adjusting means operated to adjust the swinging amplitude of the needle with a common variation rate with respect to each of the stitch control data read out from the first memory in response to the designation of the pattern signals memorized in the second memory, a third memory storing basic needle position designating signals each specific to the patterns stored in the first memory, basic needle position control means operated in reponse to the operation of the pattern memory control means to memorize a specific one of the basic needle position designating signals of the third memory to control the stitches of the designated combined patterns with a common basic needle position, calculating means operated in response to the output signal of the basic needle control means, the stitch control signal of the first memory and the output signal of the needle swing adjusting means to adjust the swinging amplitude of the needle with a common variation rate with respect to each of the stitches of the combined patterns, and to set a common basic needle position for the patterns, and stitch forming means operated in response to the output of the calculating means to produce the stitches of the combined patterns.

* * * * *